United States Patent [19]

Sakakibara et al.

[11] Patent Number: 4,643,745

[45] Date of Patent: Feb. 17, 1987

[54] AIR CLEANER USING IONIC WIND

[75] Inventors: Nobuyoshi Sakakibara, Hekinan; Tadashi Hattori, Okazaki; Kazuhiko Miura, Aichi; Hiroki Noguchi, Nishio; Akira Fukami; Teiichi Nabeta, both of Okazaki, all of Japan

[73] Assignee: Nippon Soken, Inc., Nishio, Japan

[21] Appl. No.: 682,753

[22] Filed: Dec. 17, 1984

[30] Foreign Application Priority Data

Dec. 20, 1984 [JP] Japan ..... 58-241431

[51] Int. Cl.[4] ..... B03C 3/00

[52] U.S. Cl. ..... 55/137; 55/138; 55/151; 55/152

[58] Field of Search ..... 55/2, 136–138, 55/140–143, 145, 150–155

[56] References Cited

U.S. PATENT DOCUMENTS

| | | | |
|---|---|---|---|
| 2,593,377 | 4/1952 | Wintermute | 55/124 |
| 2,978,066 | 4/1961 | Nodolf | 55/145 |
| 3,650,092 | 3/1972 | Gourdine et al. | 55/145 |
| 3,816,980 | 6/1974 | Schwab | 55/136 |
| 4,166,729 | 9/1979 | Thompcon et al. | 55/145 |
| 4,227,893 | 10/1980 | Proynoff | 55/152 |
| 4,516,991 | 5/1985 | Kawashima | 55/124 |

FOREIGN PATENT DOCUMENTS

| | | | |
|---|---|---|---|
| 24358 | 10/1966 | Japan | 55/136 |
| 52-99799 | 8/1977 | Japan . | |
| 78645 | 6/1981 | Japan | 55/152 |

*Primary Examiner*—Bernard Nozick

*Attorney, Agent, or Firm*—Cushman, Darby & Cushman

[57] ABSTRACT

An air cleaner has a discharge electrode member, an intermediate electrode member, and a counter electrode member disposed opposed and spaced apart from each other. A voltage source is connected between the discharge member and the intermediate member for generating ionic wind. A further voltage source is connected between the intermediate member and the counter member for accelerating the ionic wind such that the gradient direction of the electric field between the discharge member and the intermediate member is identical to that between the intermediate member and the counter member.

14 Claims, 11 Drawing Figures

AIR CLEANER USING IONIC WIND

BACKGROUND OF THE INVENTION

1. Field of the Invention

The present invention relates to an air cleaner using an ionic wind generated upon application of voltage between a discharge electrode and a counter electrode.

2. Description of the Related Art

Air cleaners can be installed in a room to remove dust, cigarette smoke, and the like from the room air. Such air cleaners fundamentally include air circulating means and dust collecting means. The air circulating means conventionally includes an electric motor, a fan driven by the motor, and air ducts. This makes air cleaners relatively large in size and in weight.

When the same air cleaners are installed in the passenger compartment of an automobile, their large size and weight necessitate their being located on the rear board of the compartment. In the case of rear board installation, however, the air cleaners cannot immediately catch cigarette smoke from the driver and other dust from the front seats. Before smoke, etc. reaches the rear board, it contaminates passengers in the rear seats, the upholstering of the seats and ceiling, etc. The smoke, etc., also diffuses over a greater volume of air, thus necessitating larger air treatment capacities on the part of the air cleaners.

There is known in the art an air circulating means which generates an "ionic wind". The term "ionic wind" refers to the phenomenon in which air in the vicinity of a discharge electrode is ionized by a corona discharge, which ions then move by electrostatic force toward the counter electrode. During motion of the ions, a number of neutral molecules are scattered to produce a molecular flow, i.e., a wind. The ionic wind may have a speed of several meters per second, adjustable according to the voltage applied. When the corona discharge occurs, dust in the air is also ionized. This ionized dust can be collected on downstream electrodes by an electrostatic dust collecting means.

Japanese Unexamined Patent Publication (Kokai) No. 52-99799 discloses an ionic wind generating device including a discharge electrode, a grounded counter object, and an intermediate control electrode. The control electrode has a central opening through which ionic wind passes toward the object. According to this publication, uniform distribution of the ionic wind can be obtained from the opening to the object by making the slopes of the end configuration of the discharge electrode parallel to the opposing surfaces of the control electrode.

This type of ionic wind generating device cannot be used in an air cleaner, however, because the actual air cleaner must include a plurality of such devices in an air passage defined in a case of the air cleaner and the opposing surface of the control electrode defining the central opening obstructs the flow of air.

There is the further problem of the generation of ozone ($O_3$) by the corona discharge. Ozone is toxic at high concentrations and, even at low concentrations, gives off an unpleasant smell. High voltages are required to generate sufficient ionic wind for a practical air cleaner, yet the higher the voltage, the larger amount of ozone generated.

SUMMARY OF THE INVENTION

The object of the present invention is to provide an improved, compact air cleaner using ionic wind, wherein the speed of the ionic wind can be increased with less generation of ozone.

According to the present invention, there is provided an air cleaner using ionic wind including a case having an air passage therethrough; a discharge electrode means arranged in the air passage; an intermediate electrode means opposed to and spaced apart from the discharge electrode means in the air passage; a counter electrode means opposed to the intermediate electrode means on a side remote from the discharge electrode means and spaced apart from the intermediate electrode means; a first electric source for applying voltage between the discharge electrode means and the intermediate electrode means to cause ionization on or adjacent to the discharge electrode means to generate ionic wind from the discharge electrode means through the intermediate electrode means; and a second electric source for applying voltage between the intermediate electrode means and the counter electrode means, the gradient direction of the electric field by the second electric source being identical to that by the first electric source with the intermediate electrode means grounded, the electric field of the second electric source causing the generated ionic wind to be accelerated.

DESCRIPTION OF THE PREFERRED EMBODIMENTS

Figure 1:
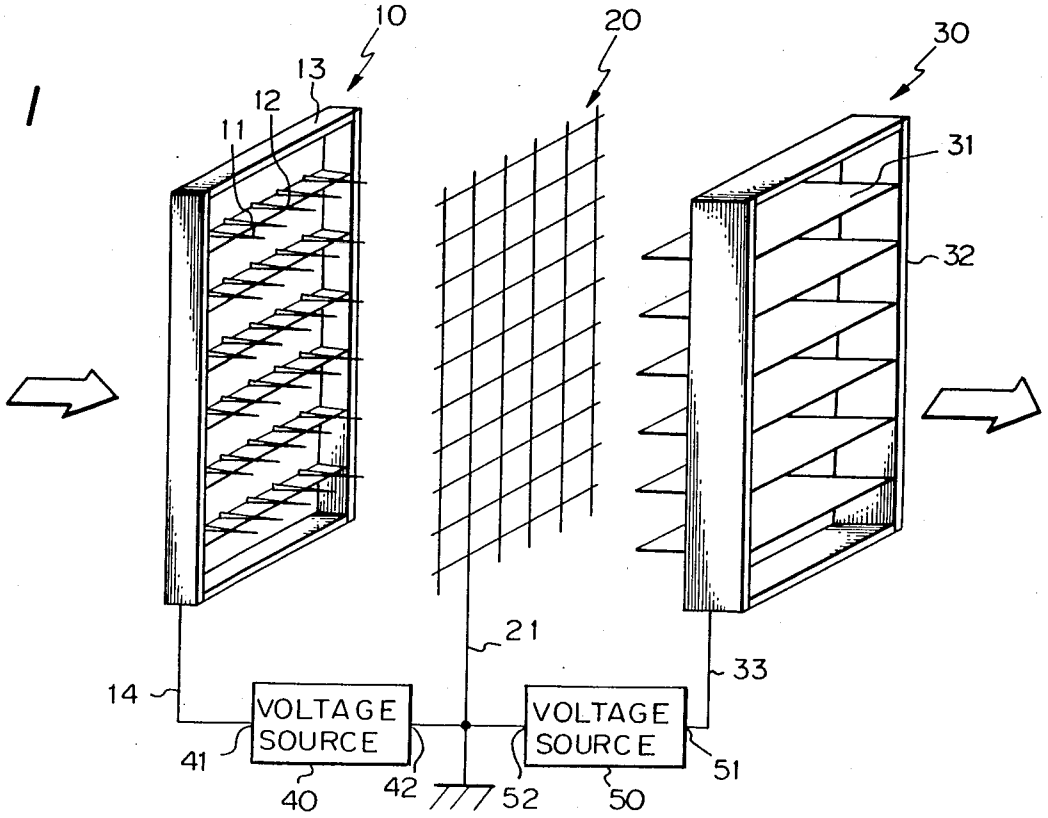
FIG. 1 is a schematic view of basic components of an air cleaner according to a first embodiment of the present invention.

Referring to FIG. 1, a discharge electrode member 10, an intermediate member 20, and a counter electrode member 30 are arranged, in an air passage defined in an air cleaner case (not shown), opposed to and spaced apart from each other. The air passage is assumed to allow a flow of air in the direction indicated by the arrow. The discharge electrode member 10 is located on the upstream side, and the counter electrode member 30 is located on the downstream side with the intermediate electrode member 20 therebetween. Each member 10, 20, and 30 extends across the air passage while permitting the air to pass therethrough.

The discharge electrode member 10 includes a plurality of needle electrodes 11, a plurality of metal plates 12, and a metal frame 13. The needle electrodes 11 are made of tungsten or iron coated with gold or platinum. The tapered edges of the needle electrodes 11 are pointed in the downstream direction of the flow of air. The proximal ends of the needle electrodes 11 are fixed at equal intervals by welding or the like to the surfaces of stainless steel plates 12 perpendicular to the long sides of the plates 12 and in a single plane perpendicular to the air passage. The plates 12 are arranged parallel to each other at equal distances corresponding to the intervals between the needle electrodes 11. The plates 12 are conductively fixed by welding or the like to a metal frame 13. Therefore, the needle electrodes 11 are uniformly arranged at equal intervals in a matrix in the metal frame 13. The metal frame 13, which surrounds the needle electrodes 11, defines a part of the air passage. Further, the distal edges of the needle electrodes 11 project from the metal frame 13 toward the intermediate electrode member 20 to enable stable corona discharge.

The intermediate electrode member 20 includes a wire net and its supporting frame (not shown in FIG. 1). The wire net is made of a non-oxidizable metal such as stainless steel. The mesh is selected to allow substantially free passage of air. A wire net is preferable as the intermediate electrode since it provides a voltage receiving planar surface opposed to the needle electrodes 11 while allowing great passage of air, the planar surface being as thin as possible in the air flow direction. If the intermediate electrode consisted of plates arranged in the flow direction, such as plate 31, described hereafter, ions or ionized particulate would be attracted, to the plates, resulting in reduced flow speed.

The counter electrode member 30 includes a plurality of metal plates 31 and a metal frame 32. The metal plates 31 are parallelly arranged one over the other to each other at equal intervals. The metal plates 31 are conductively connected to the metal frame 32 by welding or the like. The edges of the plates 31 facing the intermediate electrode member 20 project from the frame 32. The electric field between the intermediate electrode member 20 and the plate electrodes 31 are thus less affected by the metal frame 32.

A first direct-current (DC) high voltage source 40 applies voltage between the discharge electrode member 10 and the intermediate electrode member 20. One terminal 41 of the first voltage source 40 is connected via a lead 14 to the frame 13, which is electrically conductive to the needle electrodes 11, the other terminal 42 is connected to the intermediate electrode member 20 via lead 21, which is grounded. A second DC high voltage source 50 applies voltage between the intermediate electrode member 20 and the metal frame 32 of the counter electrode member 30, with one terminal 51 having a reverse polarity from the terminal 41 connected to the counter electrode member 30 via a lead 33. The other terminal 52 is connected to the grounded intermediate electrode member 20. This electrical connection will be further apparent from FIG. 2, wherein the terminal 41 is a negative pole of the voltage source 40 and the terminal 51 is a positive pole of the voltage source 50. The reverse connection in which the terminal 41 is positive and the terminal 51 is negative is possible according to the invention. It is important, according to the invention, that the intermediate electrode member 20 be grounded and the gradient direction of the electric field between members 10 and 20 be identical with that between members 20 and 30.

Figure 2:
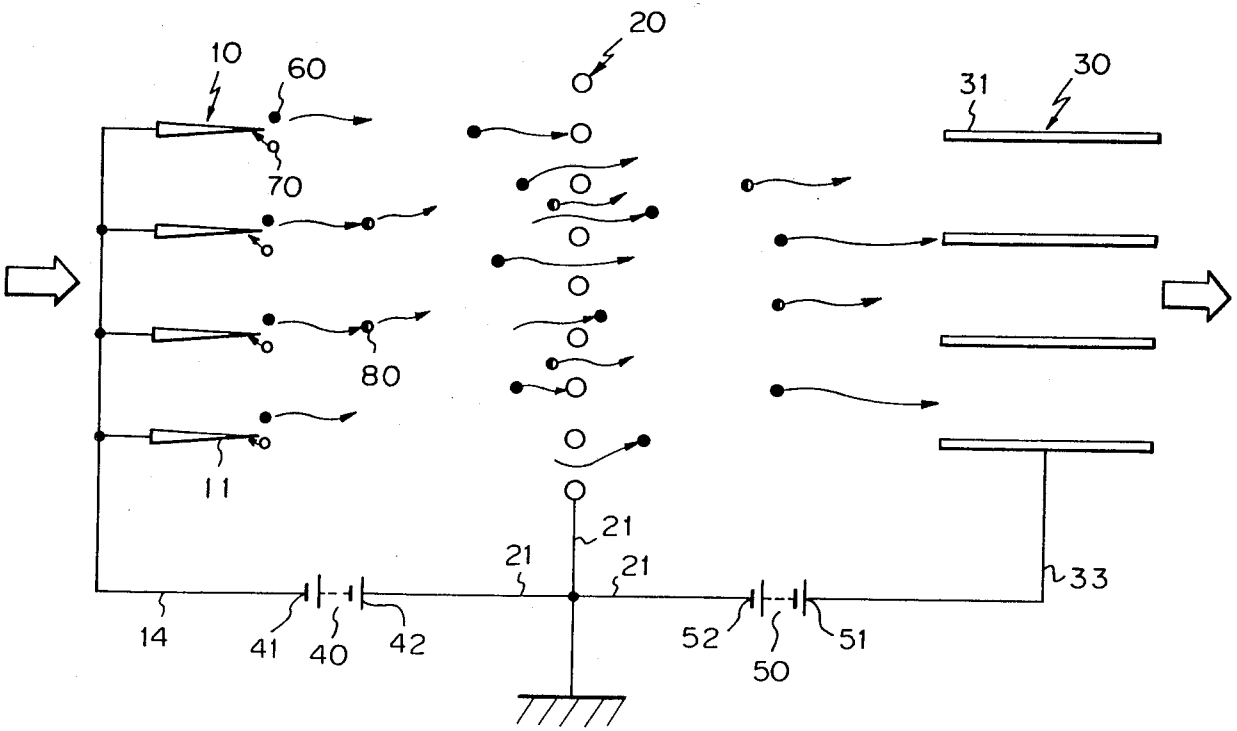
FIG. 2 is a view illustrating the principle of the air cleaner of FIG. 1.

The operation of the air cleaner shown in FIG. 1 will now be described with reference to FIG. 2.

When a voltage of several kilovolts to several tens of kilovolts is applied by the DC voltage sources 40 and 50, respectively, a corona is generated at the tapered end of each electrode 11. Therefore, a corona discharge occurs on or adjacent to the needle electrodes 11. The corona discharge produces ions of both positive and negative polarity. The positive ions 70, which bear a reverse polarity to the needle electrodes 11, are attracted to the needle electrodes 11, whereas the negative ions 60, bearing the same polarity as the needle electrodes 11, are attracted by the intermediate electrode member 20. The negative ions 60 collide with a number of neutral gas molecules 80 in their travel toward the intermediate electrode member 20, providing kinetic energy to move the neutral gas molecules 80. Thus, both the negative ions 60 and the neutral gas molecules 80 move toward the intermediate electrode member 20, generating an ionic wind. The flow of this wind is shown by the arrows in FIG. 2. Some of the negative ions 60 may be trapped at the intermediate electrode member 20, but the remainder pass through the member 20. The negative electron 60 passing through the member 20, accelerate in the electric field between the intermediate electrode member 20 and the counter electrode member 30. The neutral gas molecules 80 receive further energy from the accelerated negative ions 60 and the speed of the ionic wind is thus increased.

At the vicinity of the needle electrodes 11, the corona discharge produces ozone ($O_3$) as well as ions. This is because the energy which dissociates the molecular oxygen ($O_2$) to atomic oxygen (O) is smaller than the ionization energy of gas molecules in the air, so that the molecular oxygen ($O_2$), receiving energy smaller than the ionization energy and larger than the dissociation energy, is dissociated to atomic oxygen (O), which oxidizes the molecular oxygen ($O_2$) to ozone ($O_3$).

The amount of ozone generated is determined mainly by the electric field strength at the vicinity of the needle electrodes 11. The voltage applied to the counter electrode member 30 does not substantially increase the ozone. Accordingly, application of voltage to the counter electrode member 30 enables increased speed of the ionic wind with less ozone generation.

Dust and other particles carried in the air are charged by the ions and adhere to the intermediate electrode member 20 and the counter electrode member 30 by electrostatic force. Since, in this embodiment, the counter electrode member 30 includes plate electrodes 31, the charged dust can be readily adhered to it and the member 30 can function as a dust collecting electrode member.

Figure 3:
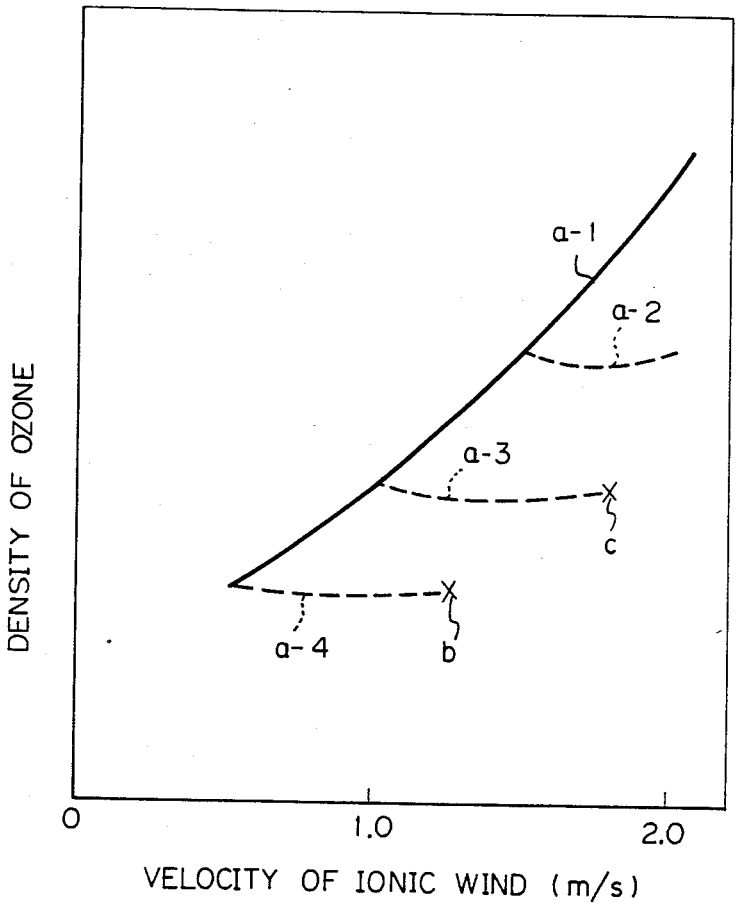
FIG. 3 is a graph showing the relationship between the density of ozone and the speed of ionic wind.

FIG. 3 shows the concentration of ozone relative to the speed of the ionic wind. The solid line curve a-1 represents the state where no voltage is applied to the counter electrode member 30 in FIG. 2, and, thus, ionic wind is generated only by the application of voltage to the discharge electrode member 10. Incidentally, an increase in the speed of the ionic wind corresponds to an increase in the voltage applied to the needle electrodes 11. The broken line curves a-2, a-3, and a-4 represent states where constant voltages selected so to result in initial speeds $V_0$ of electrode 10 only, 1.5, 1.0, and 0.5 meter per second, respectively, are applied to the discharge electrode member 10 an increasing voltage is applied to the counter electrode member 30. It is clear that while the ozone concentration increases with the speed of the ionic wind in curve a-1, it does not materially change in the case of curves a-2, a-3, and a-4.

The points b and c in FIG. 3 represent points at which spark discharge occurs between the intermediate electrode member 20 and the counter electrode member 30. At these points, the electric field strength between the intermediate electrode member 20 and the counter electrode member 30 becomes too strong and may result in field breakdown. The electric field between the intermediate electrode member 20 and the counter electrode member 30 is close to a mean electric field, therefore, the distance $l_2$ between the intermediate electrode member 20 and the counter electrode member 30 can be increased to weaken, in inverse proportion, the electric field strength. In other words, the voltage immediately before spark discharge is proportional to the distance $l_2$. Thus, the greater the distance $l_2$, the greater the speed of the generated ionic wind. As it would be too expensive to manufacture a voltage source 50 to provide too high a voltage, however, it is preferable to set the maximum voltage at 10 kilovolt. In that case, the distance $l_2$ should be from 10 mm to 15 mm.

The intermediate electrode member 20 must create a corona discharge with the opposed discharge electrode member 10 and allow ions to pass therethrough. If the intermediate electrode member 20 is formed by too coarse a mesh, the strength of the electric field between the discharge electrode member 10 and the intermediate electrode member 20 becomes too small and the corona discharge is restricted. A higher voltage could be used to overcome this, but it would increase the ozone. If the mesh is too fine, the pressure loss becomes greater and the accelerating effect is reduced by the smaller passability of ions through the net. Under a voltage to the discharge electrode 10 of 10 kilovolt or less and an initial speed $V_0$ of 0.5 meter per second or more, a wire net of mesh numbers (per inch) from 4 to 16 is preferable to obtain increased wind speed by the accelerating effect.

Figure 1A:
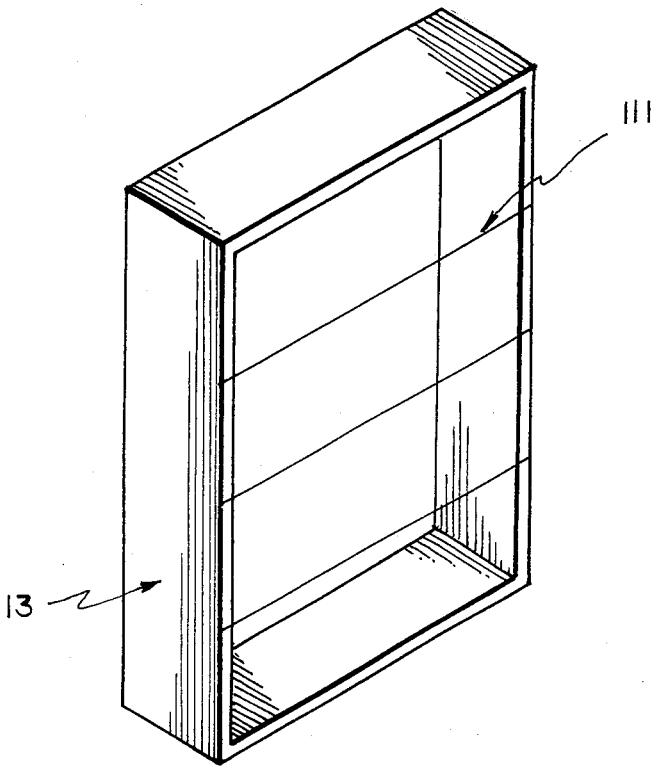
FIG. 1A shows a modification of the discharge electrode means of FIG. 1.

In the above embodiment, needle electrodes were used for the discharge electrodes. Electrically conductive wires 111 can also be used to increase the wind speed by the accelerating effect with less ozone generation as shown in FIG. 1A.

Figure 4:
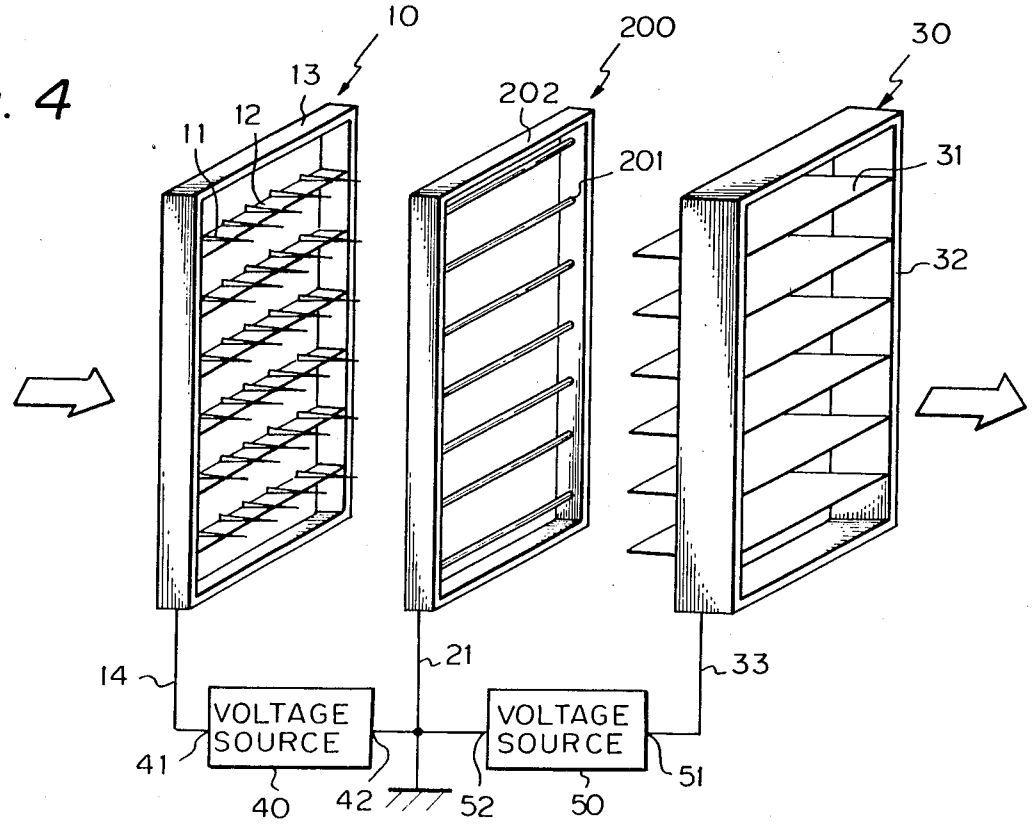
FIG. 4 is a schematic view of basic components of an air cleaner according to a second embodiment.
Figure 5:
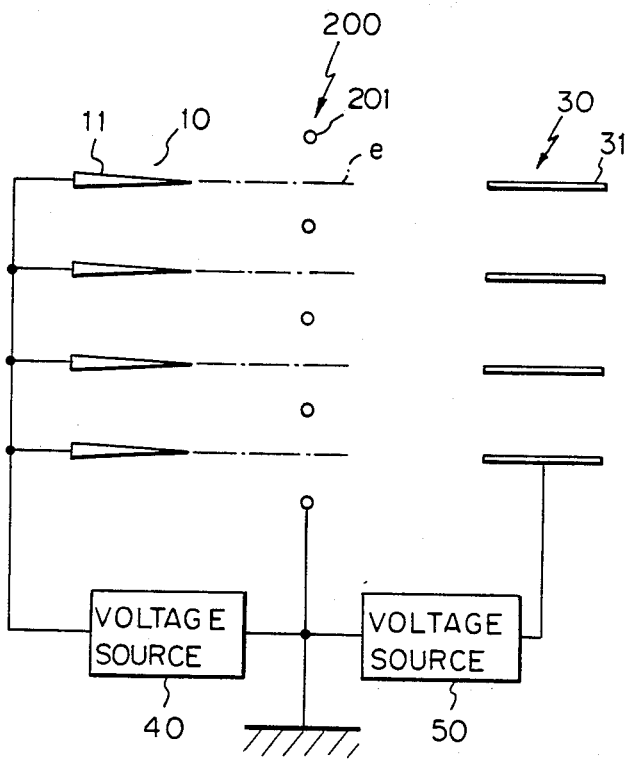
FIGS. 5 and 6 illustrate the disposition of intermediate electrodes relative to discharge electrodes according to FIG. 4.
Figure 6:
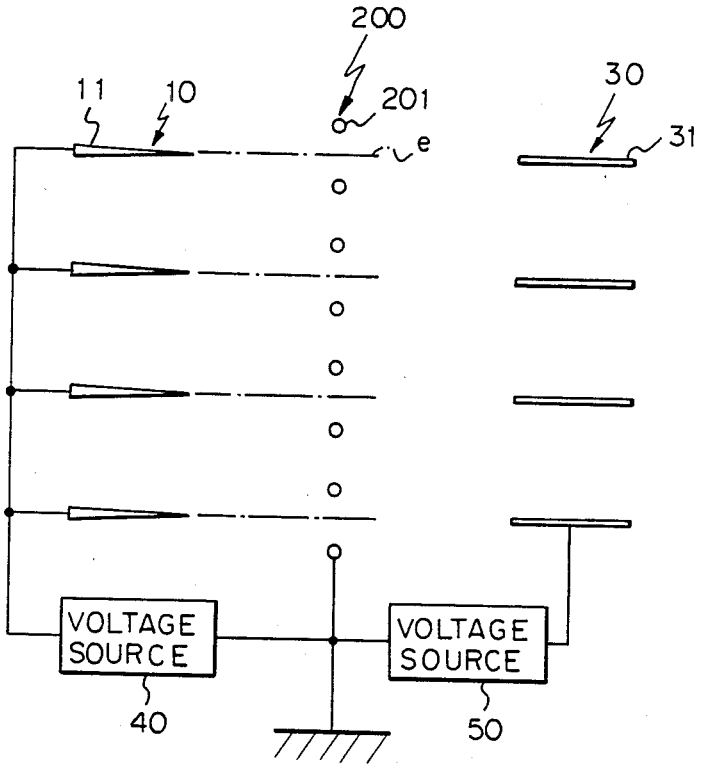

FIGS. 4 and 5 illustrate a second embodiment of the present invention. Members 10 and 30 are similar to those shown in FIG. 1. An intermediate electrode member 200 includes a plurality of metal rods 201 and a supporting frame 202. The rods 201 are made of stainless steel or other conductive material and are conductively fixed to the frame 202 by welding, brazing, or other fixing means such as in a parallel array at constant intervals in a plane perpendicular to the flow direction. The number of the rods 201 is greater than that of the parallel plates 12 of the discharge member 10 by one, the plates 12 being alternately disposed relative to the rods 201 such that lines e from the needle electrodes 11 extend between two adjacent rod 201, as is shown in FIG. 5. This disposition improves the acceleration of the ionic wind. Since the corona discharge occurs from the edges of the needle electrodes 11, the density of ions is higher at the extension lines e. Therefore, less ions are trapped by the metal rods 201 as compared to when the needle electrodes 11 and rods 201 are aligned, resulting in increased passage of ions through the intermediate member 200. Alternatively, as shown in FIG. 6, the interval of the rods 201 can be half that of the needle electrodes 11 and rods 201 shifted from the extension lines e. This disposition gives similar advantages to that of FIG. 5.

Figure 7:
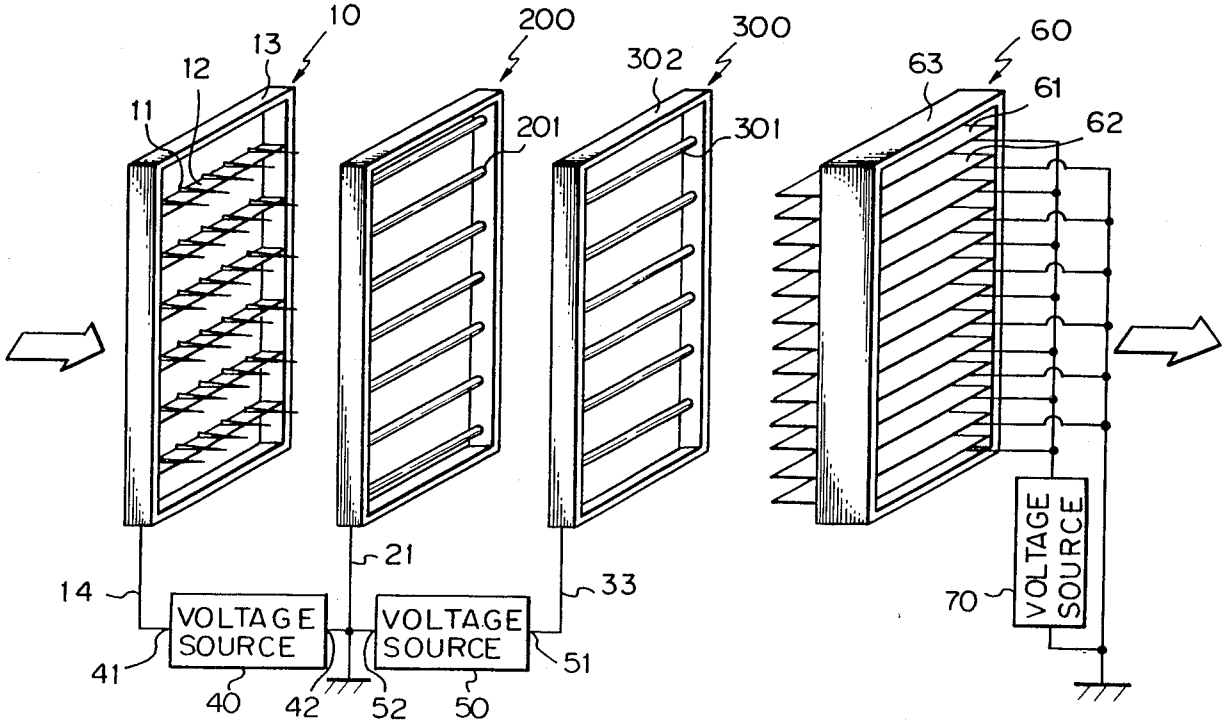
FIG. 7 is a perspective view of a third embodiment of the present invention.

FIG. 7 shows a third embodiment of the present invention. A further dust collecting electrode member 60 is provided on the downstream side of a counter electrode member 300, which includes a plurality of rod electrodes 301 and an electrically conductive frame 302. The dust collecting electrode member 60 includes two sets of alternatingly arranged plate electrodes 61 and 62. All the plates 61 and 62 are mounted parallel to each other at a constant intervals to a frame 63. The set of plates 61 are connected to the negative terminal of a voltage source 70 and the other set of plates 62 to the positive terminal of the source 70, which is grounded. On applying voltages to electrode members 10, 200, 300 and 60 from the voltage sources 40, 50, and 70, respectively, the negative ions caused by the corona discharge (when the negative voltage is applied to the discharge electrode member 10) are directed to generate an ionic wind, as described previously. The dust in the wind is charged negatively by the negative ions attached thereto. Part of the negative-charged dust is attracted to the intermediate electrode member 200 and the counter electrode member 300. The remaining dust passes through these electrodes to reach the dust collecting electrode member 60 together with the wind. The charged dust is then attached to the plates 62 by the electric field between each adjacent plates 61 and 62.

This arrangement increases the dust collecting efficiency by making the electric field perpendicular to the wind flow direction and also generates accelerated ionic wind with less ozone. This arrangement may be further modified; for example, the rod electrodes 301 of the counter electrode member 300 may be made a wire net electrode or plate electrodes of appropriate size or intervals.

Figure 8:
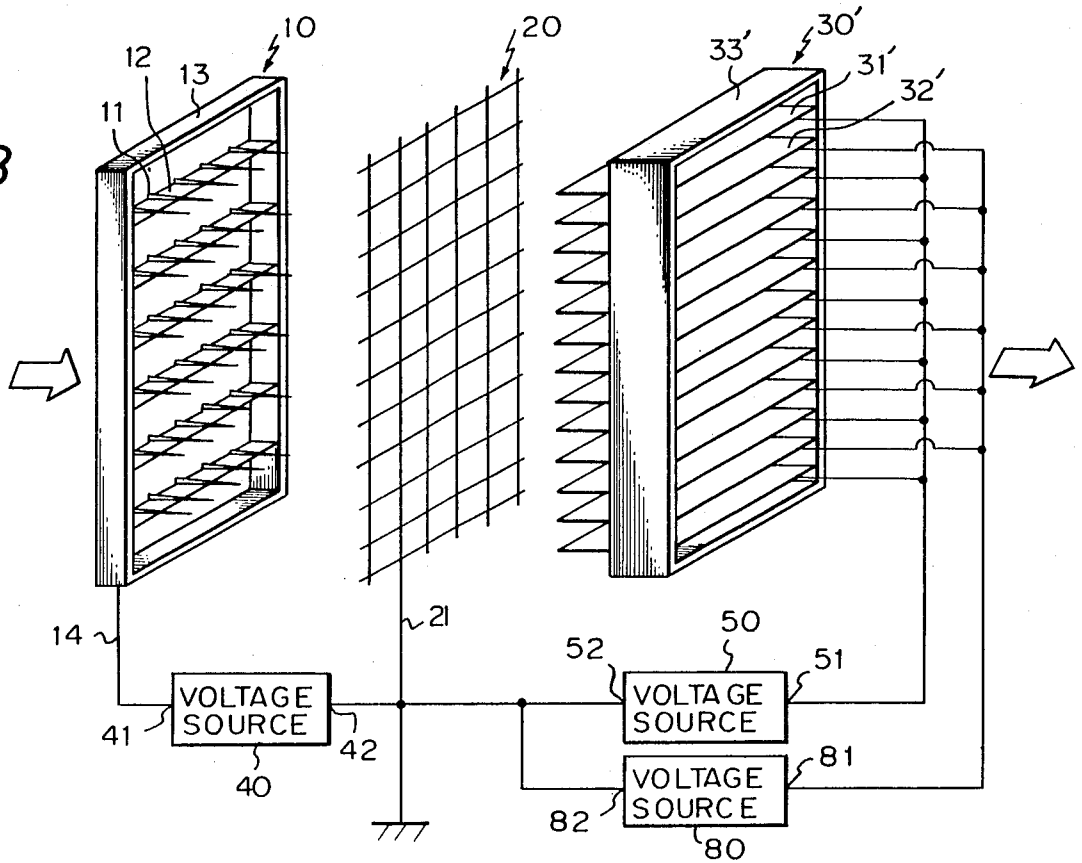
FIG. 8 is a perspective view of a fourth embodiment of the present invention.

FIG. 8 is a view of still another embodiment of the present invention. Components 10, 20, 30', 40, and 50 are similar to those shown in FIG. 1, but the counter electrode member 30' includes two sets of plates 31' and 32' which are mounted to an insulating frame 33', the plates 31' and 32' alternately arranged in parallel at constant intervals. One set of plates 31' is connected to the voltage source 50 is a manner described previously so as to generate and accelerate the wind. The other set of plates 32' is connected to one terminal 81 of a further voltage source 80 which applies a lower voltage than the source 50, the polarity of the terminal 81 being reverse to that of the terminal 41 for the discharge electrode member 10, that is, identical to the polarity of the terminal 51 for the one set of plates 31'. The other terminal 82 is grounded. Thus, the electric field between the members 10 and 20 has the same polarity as the electric field between the members 20 and 30', the member 30' making the electric field perpendicular to the air flow direction to increase the dust collecting effciency with the accelerated wind.

Figure 9:
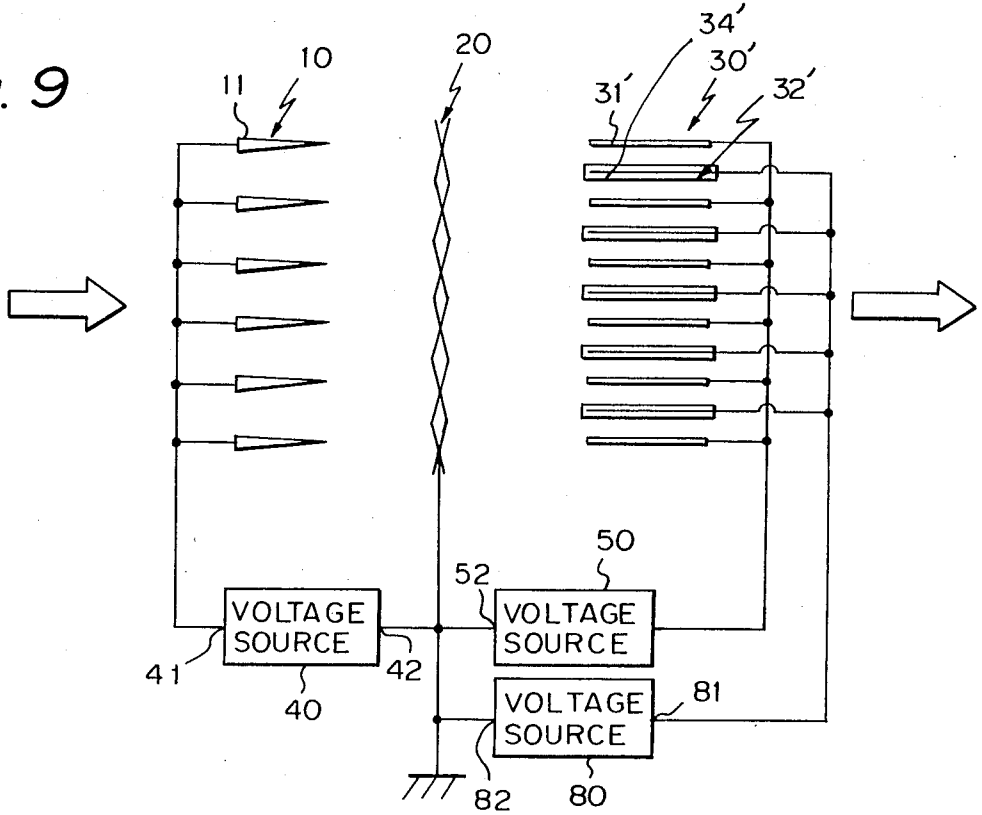
FIG. 9 is a view of a fifth embodiment of the present invention.

FIG. 9 shows still another embodiment, similar to that of FIG. 8 but with one set 32' of the two sets of plates 31' and 32' of the counter electrode member 30' covered with insulating material 34'. Therefore, the withstand voltage strength between each adjacent plates 31' and 32' is increased, increasing the electric field strength and resulting in increased dust collecting efficiency. Since the electric field strength can be increased, the desired level of dust collecting efficiency can further be obtained by a smaller counter electrode member 30'.

Figure 10:
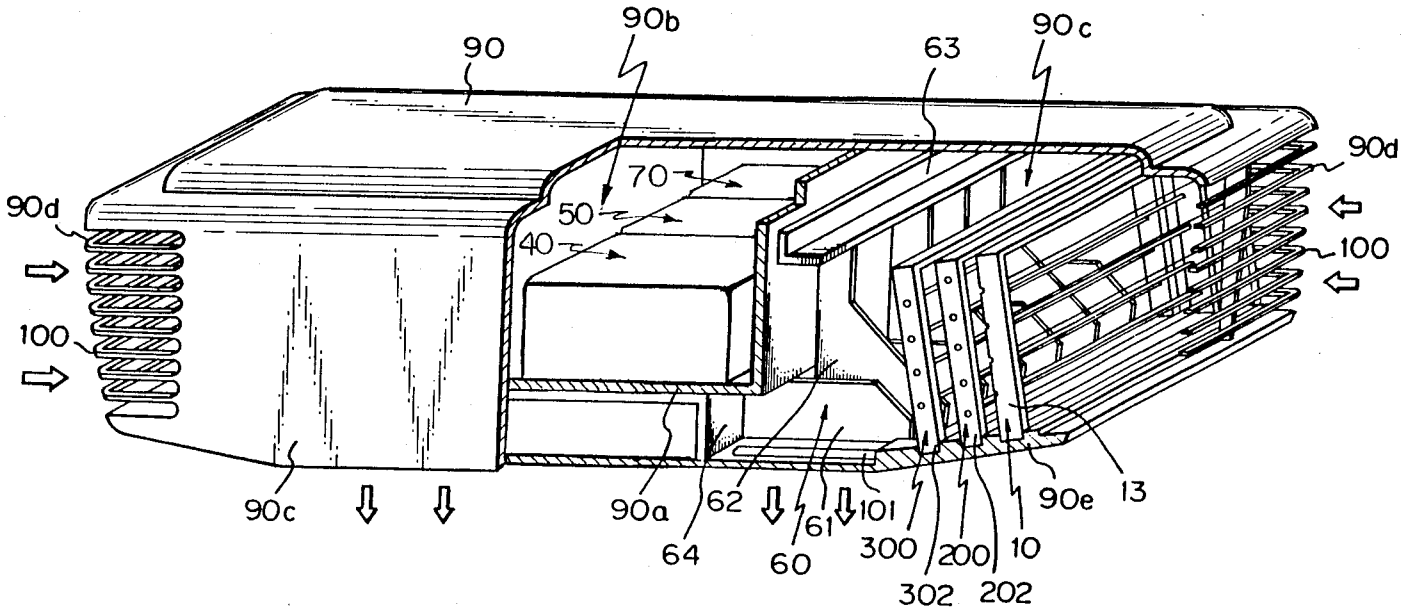
FIG. 10 is a partially cut away perspective view of an air cleaner including the components of FIG. 7.

FIG. 10 shows an air cleaner, adapted for use in an automobile passenger compartment. The air cleaner has a case 90 made of electrically insulating material such as acrylonitrile butadiene styrene resin. The case is adapted for mounting on the ceiling of the compartment. The case 90 has an internal wall 90*a* which separates the case 90 into three portions. A central portion 90*b* is adapted to house high voltage sources such as 40, 50, and 70. On either side of the central portion 90*b*, ionic wind generating portions 90*c* are symmetrically arranged. Each generating portion 90*c* has an air inlet 100 defined by a grill 90*d* at the lateral side of the case 90 and an air outlet defined by slits at the bottom. Inside the case 90, a discharge electrode member 10, an intermediate electrode member 200, a counter electrode member 300, and a dust electrode member 60 are arranged in series at predetermined distances with the discharge electrode member 10 nearer to the air inlet. Members 10, 200, 300, and 60 correspond to those shown in the previous figures. Members 10, 200, and 300 have a frame 13, 202, and 302, respectively, by which they are attached to the base 90*e* or other wall of the case 90. One set of plate electrodes 61 of the dust collecting electrode member 60 are electrically and mechanically connected to a conductive electrode holder 64, which is fixed to the internal wall 90*a* by screws or the like and which is electrically connected to the voltage source 70 by a lead (not shown). The other set of plate electrodes 62 are fixed to the internal wall 90*a* by the frame 63, and electrically connected to the voltage source 70. The other members 10, 200, and 300 are electrically connected to the voltage sources in the central portion 90*b* by leads (not shown) in a manner described previously. It will be apparent that this air cleaner is very simple in construction and does not use mechanical wind generating components such as an electric motor and fan. This air cleaner can suck in dusty air from both air inlets 100 at the sides and deliver clean air from the air outlet 101 at the bottom.

We claim:

1. An air cleaner using ionic wind comprising:

a case having an air passage therethrough;

discharge electrode means arranged in said air passage, said discharge electrode means including a plurality of electrode members having sharpened portions, respectively, said sharpened portions being distributed in a plane across said air passage;

intermediate electrode means arranged in said air passage at a predetermined distance from said discharge electrode means along said air passage, said intermediate electrode means including electrode members which extend in parallel to each other in a plane across said air passage and which have diametrical dimensions considerably larger than those of said sharpened portions of said discharge electrode means so that corona discharge occurs on or adjacent to said sharpened portions of said discharge electrode means upon the application of voltage between said discharge and intermediate electrode means;

counter electrode means for collecting dust arranged in said air passage at a predetermined distance from said intermediate electrode means along said air passage on a side remote from said discharge electrode means, said counter electrode means including a plurality of plate electrodes arranged parallel to each other and generally perpendicular to said air passage;

a first electric source for applying voltage between said discharge electrode means and said intermediate electrode means to cause ionization on or adjacent to said discharge electrode means to generate ionic wind said discharge electrode means through said intermediate electrode means; and a second electric source for applying voltage between said intermediate electrode means and said counter electrode means, the gradient direction of the electric field by said second electric source being identical to that by said first electric source with said intermediate electrode means grounded, the electric field of said second electric source applied between said intermediate electrode means and said counter electrode means causing the generated ionic wind to be accelerated.

2. An air cleaner according to claim 1, wherein said plate electrodes comprise two alternating sets of plates, one set being connected to said second electric source, the other set being connected to a further electric source.

3. An air cleaner according to claim 1, wherein the distance between the intermediate electrode means and the counter electrode means is in the range from 10 to 15 mm.

4. An air cleaner according to claim 1, wherein each of said discharge electrode means, said intermediate electrode means, and said counter electrode means extends substantially across said air passage while permitting the air to pass therethrough.

5. An air cleaner according to claim 4, wherein said intermediate electrode means comprises a metal net.

6. An air cleaner according to claim 5, wherein the mesh number of said metal net is in a range from 4 to 16.

7. An air cleaner according to claim 4, wherein said intermediate electrode means comprises a plurality of rod electrodes arranged on a plane across said air passage.

8. An air cleaner according to claim 7, wherein said plurality of electrode members comprises a plurality of needle electrodes, the disposition of the needle electrodes relative to said rod electrodes of said intermediate electrode means being such that the extension lines from each of said needle electrodes are shifted from the rod electrodes.

9. An air cleaner according to claim 4, wherein said plurality of electrode members comprises a plurality of needle electrodes which are distributed generally uniformly in said air passage in said single plane.

10. An air cleaner according to claim 9, wherein said needle electrodes are attached to a plurality of parallel plates which are supported to a frame.

11. An air cleaner according to claim 10, wherein said frame and said plates are electrically conductive, said first electric source being connected to said frame.

12. An air cleaner ionic wind comprising:

a case having an air passage therethrough;

discharge electrode means arranged in said air passage, said discharge electrode means including a plurality of electrode members having sharpened portions, respectively, said sharpened portions being distributed in a plane across said air passage;

intermediate electrode means arranged in said air passage at a predetermined distance from said discharge electrode means along said air passage, said intermediate electrode means including electrode members which extend in parallel to each other in a plane across said air passage and which have diametrical dimensions considerably larger than those of said sharpened portions of said discharge electrode means so that corona discharge occurs on or adjacent to said sharpened portions of said discharge electrode means upon the application of voltage between said discharge and intermediate electrode means;

counter electrode means arranged in said air passage at a predetermined distance from said intermediate electrode means along said air passage on a side remote from said discharge electrode means;

dust collecting electrode means provided on a side of the counter electrode means remote from the intermediate electrode means;

a first electric source for applying voltage between said discharge electrode means and said intermediate electrode means to cause ionization on or adjacent to said discharge electrode means to generate ionic wind from said discharge electrode means through said intermediate electrode means;

a second electric source for applying voltage between said intermediate electrode means and said counter electrode means, the gradient direction of the electric field by said second electric source being identical to that by said first electric source with said intermediate electrode means grounded, the electric field of said second electric source applied between said intermediate electrode means and said counter electrode means causing the generated ionic wind to be accelerated; and a third electric source for applying voltage between components of said dust collecting electrode means.

13. An air cleaner according to claim 12, wherein said dust collecting electrode means comprises a plurality of parallel plate electrodes and a electric source connected to said plate electrodes so as to make an electric field between two adjacent plates in a direction perpendicular to the air passage.

14. An air cleaner using ionic wind comprising:

a case having two symmetrical portions, each of said symmetrical portions having an air inlet at the side of the case, an air outlet at the bottom of the case, and an air passage, each of said symmetrical portions further comprising:

discharge electrode means arranged in said air passage, said discharge electrode means including a plurality of electrode members having sharpened portions, respectively, said sharpened portions being distributed in a plane across said air passage;

intermediate electrode means arranged in said air passage at a predetermined distance from said discharge electrode means along said air passage, said intermediate electrode means including electrode members which extend in parallel to each other in a plane across said air passage and which have diametrical dimensions considerably larger than those of said sharpened portions of said discharge electrode means so that corona discharge occurs on or adjacent to said sharpened portions of said discharge electrode means upon the application of voltage between said discharge and intermediate electrode means;

counter electrode means for collecting dust arranged in said air passage at a predetermined distance from said intermediate electrode means along said air passage on a side remote from said discharge electrode means;

a first electric source for applying voltage between said discharge electrode means and said intermediate electrode means to cause ionization on or adjacent to said discharge electrode means to generate ionic wind from said discharge electrode means through said intermediate electrode means; and a second electric source for applying voltage between said intermediate electrode means and said counter electrode means, the gradient direction of the electric field by said second electric source being identical to that by said first electric source with said intermediate electrode means grounded, the electric field of said second electric source applied between said intermediate electrode means and said counter electrode means causing the generated ionic wind to be accelerated.

* * * * *